United States Patent [19]

Kamezaki

[11] Patent Number: 4,672,017

[45] Date of Patent: Jun. 9, 1987

[54] ELECTROPHOTOGRAPHIC DEVELOPING METHOD

[75] Inventor: Yasushi Kamezaki, Sakai, Japan

[73] Assignee: Mita Industrial Co., Ltd., Osaka, Japan

[21] Appl. No.: 802,022

[22] Filed: Nov. 25, 1985

[30] Foreign Application Priority Data

Nov. 27, 1984 [JP] Japan ..... 59-248678
Nov. 27, 1984 [JP] Japan ..... 59-248679

[51] Int. Cl.[4] ..... G03G 15/09
[52] U.S. Cl. ..... 430/122; 118/658
[58] Field of Search ..... 430/122, 102; 118/658

[56] References Cited

U.S. PATENT DOCUMENTS 4,391,512 7/1983 Nakamura et al. ..... 118/658
4,425,373 1/1984 Hosono et al. ..... 118/658
4,444,864 4/1984 Takahashi et al. ..... 118/658
4,554,234 11/1985 Imai et al. ..... 118/658

*Primary Examiner*—John L. Goodrow
*Attorney, Agent, or Firm*—Sherman and Shalloway

[57] ABSTRACT

A developing method for forming a toner image of high quality which comprises supplying a two-component developer composed of a mixture of magnetic carrier particles and toner particles chargeable by frictional contact with the magnetic carrier particles onto a development sleeve comprised of a non-magnetic sleeve and provided therein, a magnet having alternately and circumferentially arranged magnetic poles of different polarities to thereby form a magnetic brush of the developer, and bringing the surface of a photosensitive drum bearing a latent electrostatic image into frictional contact with the magnetic brush while a bias voltage is applied between the photosensitive drum and the sleeve thereby to form a toner image corresponding to the latent electrostatic image; characterized in that a brush cutting doctor is disposed on the non-magnetic sleeve so that the tip of the doctor is positioned nearly centrally between two magnetic poles of different polarities, and the development is carried out while moving the photo-sensitive drum and the development sleeve in the same direction at the site of frictional contact and the concentration (Ct, %) of the toner in the developer satisfies the following equation $$Ct = k \cdot \frac{Sc}{St + Sc} \times 100$$

wherein Sc is the specific surface area ($cm^2/g$) of the carrier, St is the specific surface area ($cm^2/g$) of the toner, and k is a number of from 0.80 to 1.14.

11 Claims, 3 Drawing Figures

ELECTROPHOTOGRAPHIC DEVELOPING METHOD

BACKGROUND OF THE INVENTION

1. Field of the Invention

This invention relates to an electrophotographic developing method, and more specifically, to a magnetic brush developing method for forming a toner image of high quality by using a two-component developer comprising a magnetic carrier and a chargeable toner. The invention also pertains to a method for forming an image of high quality easily and conveniently without the need for a high level of mechanical precision in a development section.

2. Description of the Prior Art

In electrophotography using a two-component magnetic developer, a chargeable toner and a magnetic carrier are mixed and the two-component mixture is fed onto a development sleeve equipped with a magnet therein to form a magnetic brush composed of this mixture. By bringing the magnetic brush into frictional contact with an electrophotographic plate bearing a latent electrostatic image, a chargeable toner image is formed on the electrophotographic plate. The chargeable toner, upon frictional contact with the magnetic carrier, is charged to a polarity opposite to that of the latent electrostatic image on the electrophotographic plate. The toner particles on the magnetic brush are attracted and adhered to the latent electrostatic image by the Coulomb force whereby the latent electrostatic image is developed. On the other hand, since the magnetic carrier is attracted by the magnet within the sleeve and its charge is of the same polarity as the charge of the latent electrostatic image, the magnetic carrier remains on the sleeve.

For the frictional contact of the magnetic brush with the photosensitive plate, two methods are available, one involving moving the two in the same direction and the other involving moving them in opposite directions. These methods have their own advantages and disadvantages. The former method of moving the two in the same direction permits soft contact between the magnetic brush and the surface of the photosensitive plate. Hence, the reproducibility of a halftone is excellent and the quality of the resulting image is generally good. But with this method, it is difficult to obtain a high image density. According to the latter method, the magnetic brush contacts the surface of the photosensitive plate while it is in the compressed state, and therefore, a high image density is easy to obtain. On the other hand, it has the defect that the resulting image has a defect called brush marks which are many rows of slender and short white lines extending in the rubbing direction of the brush, or other defects such as tailing frequently occur in the resulting image.

SUMMARY OF THE INVENTION

It is an object of this invention to provide an improvement in a magnetic brush development wherein the photosensitive plate and the magnetic brush are moved in the same direction, and particularly an improved magnetic brush development method capable of forming a toner image having high quality and a high density.

In accordance with this invention, the above object is achieved by a development method for forming a toner image of high quality, which comprises supplying a two-component developer composed of a mixture of magnetic carrier particles and toner particles chargeable by frictional contact with the magnetic carrier particles onto a development sleeve comprised of a non-magnetic sleeve and provided therein, a magnet having alternately and circumferentially arranged magnetic poles of different polarities to thereby form a magnetic brush of the developer, and bringing the surface of a photosensitive drum bearing a latent electrostatic image into frictional contact with the magnetic brush while a bias voltage is applied between the photosensitive drum and the sleeve thereby to form a toner image corresponding to the latent electrostatic image; characterized in that a brush cutting doctor is disposed on the non-magnetic sleeve so that the tip of the doctor is positioned nearly centrally between two magnetic poles of different polarities, and the development is carried out while moving the photosensitive drum and the development sleeve in the same direction at the site of frictional contact and the concentration (Ct, %) of the toner in the developer satisfies the following equation $$Ct = k \cdot \frac{Sc}{St + Sc} \times 100$$

wherein Sc is the specific surface area ($cm^2/g$) of the carrier, St is the specific surface area ($cm^2/g$) of the toner, and k is a number of from 0.80 to 1.14.

BRIEF DESCRIPTION OF THE ACCOMPANYING DRAWINGS

DETAILED DESCRIPTION OF PREFERRED EMBODIMENTS OF THE INVENTION

The invention will now be described in detail with reference to its preferred embodiments in conjunction with the accompanying drawings.

DEVELOPING DEVICE

Figure 1:
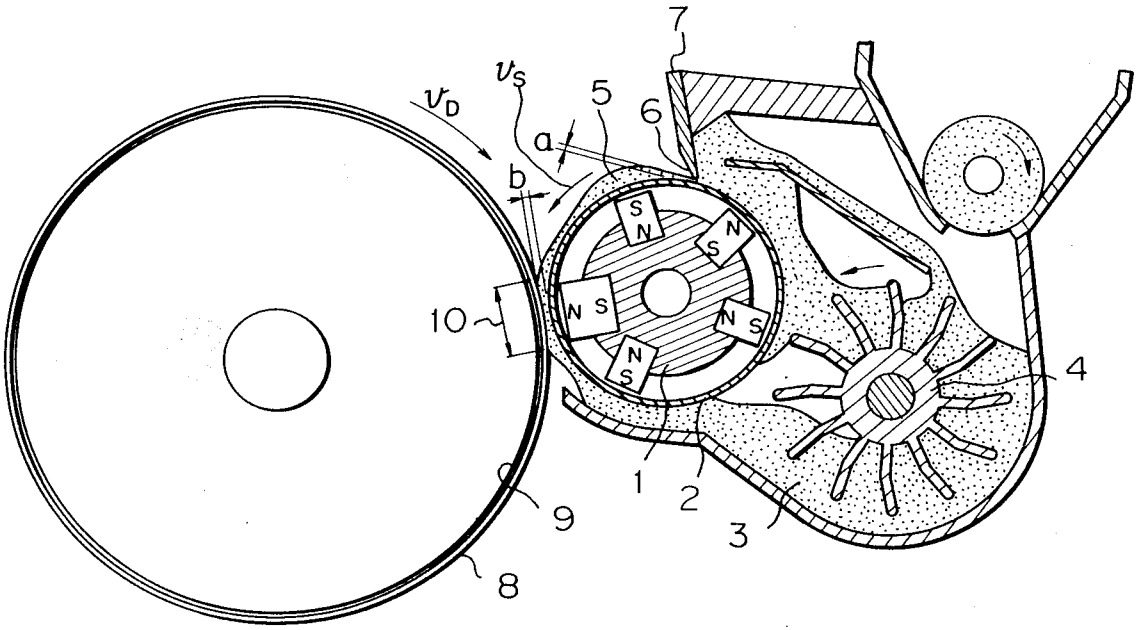
FIG. 1 is a view showing one example of a developing device used in this invention.

In one example of a developing device used in this invention which is shown in FIG. 1, a magnet roll 1 having many magnetic poles N and S is received within a sleeve 2 made of a non-magnetic material such as aluminum. The magnet roll 1 is fixed and the sleeve 2 is provided so as to rotate in the direction of the arrow, i.e. in the counterclockwise direction. A twocomponent developer 3 is supplied to the sleeve from a developer agitating and supplying roller 4 to form a magnetic brush 5. The magnetic brush 5 rotates with the sleeve 2 and thus moves in the same direction as the rotating direction of the sleeve. A brush cutting doctor 7 is provided above the sleeve 2 so that its tip 6 is positioned nearly centrally between magnetic poles N and S. The doctor 7 cuts the magnetic brush 5 to a predetermined length.

In proximity to the non-magnetic sleeve 2 is disposed a drum 9 having an electrophotographic layer 8. The electrophotographic layer 8 is rotated so that it moves in the same direction as the moving direction of the magnetic brush 5 in a development zone 10. As a result, a latent electrostatic image on the photographic layer 8 is rubbed by the magnetic brush 5 and developed by the chargeable toner.

CHARACTERISTIC FEATURES AND ADVANTAGES OF THE INVENTION

A first characteristic feature of the invention is that the brush cutting doctor 7 is disposed in the aforesaid positional relation, and the moving directions of the photosensitive drum 9 and the development sleeve 2 are made the same at the position of frictional contact.

This feature is employed in this invention for the following reasons. The development of a latent electrostatic image formed on the photosensitive drum is carried out by forming a magnetic brush of a developer composed of a toner and a carrier on the development sleeve 2 and bringing the magnetic brush into frictional contact with the photosensitive drum. The conditions for the frictional contact between the magnetic brush and the photosensitive drum at this time are important, and the quality of the resulting copy depends upon the control of these conditions.

Since the present invention contemplates the production of copies having high quality, the length of the magnetic brush is adjusted and the photosensitive drum and the development sleeve are moved in the same direction at the position of frictional contact so as to avoid any excessive force during frictional contact. To adjust the brush length, the doctor is disposed so that its tip is positioned between magnetic poles. At this position of the development sleeve, the magnetic flux is not concentrated as at the position of the magnetic poles, and the magnetic force acting on the developer is weak. Therefore, the developer does not form a brush but exists densely by its own weight on the surface of the sleeve. Accordingly, if the brush is cut at this position, it can be adjusted to a predetermined length with good precision. Since the magnetic restraining force at this position is weak, no excessive restraining force acts on the developer nor slippage of the developer occurs on the surface of the sleeve. The "slippage of the developer", as referred to herein, denotes a phenomenon in which since the magnetic interacting forces of the developer particles are large at a position near the magnetic poles where the magnetic restraining force is strong, the restriction of the tip portion of the magnetic brush results in restriction of the entire magnetic brush and hence the magnetic brush fails to move. Accordingly, if the magnetic brush is restricted between magnetic poles, cutting of the brush can be carried out stably over a long period of time, and the frictional conditions mentioned above can be easily controlled. Consequently, the latent electrostatic image can be developed to a toner image having excellent quality with an increased image density, a high resolution and excellent gradation without a signficant scattering of the toner.

A second characteristic feature of the invention is that the development is carried out while the concentration (Ct, %) of the toner in the developer satisfies the following equation $$Ct = k \cdot \frac{Sc}{St + Sc} \times 100 \qquad (1)$$

wherein Sc is the specific surface area ($cm^2/g$) of the carrier, St is the specific surface area ($cm^2/g$) of the toner, and k is a number of 0.80 to 1.14.

By a combination of these first and second features of the invention, the resulting image has an improved density, resolution and gradation and is free from fogging.

In equation (1), the term Sc/(St+Sc) on the right side relates to the specific surface areas of the carrier and the toner. Specifically it is a value expressing the proportion of the surface area of the carrier based on the total surface area of a mixture of equal weights of the carrier and the toner (to be referred to as the carrier surface occupancy ratio).

In the present invention, when an electrostatic image is developed with the two-component developer under conditions such that the concentration of the toner becomes equal to this carrier surface occupancy ratio or a value close to it, the density of the resulting image is increased simultaneously with a decrease in fog density, an increase in resolution and an improvement in gradation.

The difference between the concentration of the toner (Ct %) and the carrier surface occupancy ratio (Sc/(Sc+St), %) can be evaluated by determining the ratio of the two, namely the coefficient k of the following formula $$k = Ct/(Sc/(St+Sc)).$$

The coefficient k differs depending upon the shape of the carrier used. It is very critical with regard to the aforesaid various development characteristics to adjust the coefficient k to 0.90 to 1.14 for an irregularly shaped magnetic carrier and to 0.80 to 1.07 for a spherical magnetic carrier.

The investigations of the present inventor have shown that when the coefficient k is within the above-specified range, a higher image density, a lower fog density, a higher resolution and better gradation are obtained than when the k value is outside the specified range, and that these characteristics are hardly degraded not only in the initial stage of the development but also after as many as 30,000 to 50,000 copies have been continuously produced.

In the invention, the specific surface area (Sc) of the carrier in equation (1) means a measured value obtained by the transmission method. The transmission method is described in detail at pages 108 to 113 of "Powder Handbook", edited by Japan Powder Industry Association, published by Nikkan Kogyo Press.

The specific surface area (St) of the toner in equation (1) means an effective specific surface area which is calculated on the basis of the volume average particle diameter of the toner measured by a Coulter counter, under the assumption that the toner particles are true spheres. Specifically, it is calculated in accordance with the following formula $$St = \frac{3}{r \cdot \rho}$$

where r is the radius (cm) determined from the volume average particle diameter measured by a Coulter counter, and $\rho$ is the true specific gravity ($g/cm^3$) of the toner.

The reason for the determination of the specific surface area (St) of the toner in this way is that since the radius of the toner is much smaller than that of the carrier, the frictional contact of the toner with the carrier is limited to the raised portions on the surface of the toner and there is virtually no problem if only the raised portions on the surface are assumed to be an effective surface for triboelectrical charging, and that this assumption well agrees with the experimental fact.

In the present invention, the developer containing the toner in the concentration defined by the above equation (1) is applied to the developing method characterized by the first feature mentioned above. According to the first feature, the electrostatic image can be developed to a toner image of excellent quality. This, however, is possible only when the conditions of the developer itself are optimal. Accordingly, the first feature of the invention is inseparable from the second feature regarding the concentration of the toner defined by the empirical equation (1).

From another viewpoint. good conditions for the developer can be determined by equation (1), but this toner concentration should be satisfied at the magnetic brush with which the development is performed. As stated above, the doctor for adjusting the length of the brush to a predetermined value is used in the formation of the magnetic brush. If this adjustment is carried out in a state in which a strong force is exerted on the magnetic brush, the concentration of the toner is adversely affected. With regard to the developer on the sleeve, it is only the carrier to which the magnet roll directly imparts a conveying force. Hence, the restricting force of the tip of the doctor is liable to act on the toner which has not gained this conveying force from the magnet roll. In other words, the toner is only electrostatically bound to the carrier. As a result, the toner is detached from the carrier which tends to move against the restricting force upon the action of the magnetic conveying force thereon. Thus, since in the above state, the toner is detached from the carrier by the strong restricting force of the doctor, the developer adjusted to a predetermined toner concentration will have a toner concentration lower than the adjusted value when it is on the magnetic brush on which it contributes to the development. In the present invention, since the restricting force at the time of brush cutting can be decreased in accordance with the first feature, the variations in toner concentration during the application of the doctor can be suppressed and the concentration of the toner in accordance with the second feature can be maintained effectively. For the foregoing reason, the best developing conditions can be maintained in this invention by the effective interaction of the conditions defined by the first and second features.

A toner image of high quality can be formed in accordance with this invention by carrying out the magnetic brush development method which satisfies a combination of the first condition relating to the positional relation of the brush cutting doctor and the relation of the moving directions of the drum and the sleeve and the second condition relating to the concentration of the toner.

In the present invention, a toner image having higher quality can be formed by combining the above two conditions with one of the following two additional conditions.

A first additional condition concerns the relation between the distance (brush cutting clearance) a between the tip of the brush cutting doctor and the sleeve and the distance (development clearance) b between the drum and the sleeve. If the development method further satisfies this condition, a toner image of a high density and high quality can be formed easily without the need for a high level of mechanical precision in a development section.

The first additional condition is that the development is carried out under conditions defined by the following expressions $$(b-a) > -0.2 \log R + 1.5 \quad (2)$$

$$(b-a) \leqq -0.2 \log R + 2.0 \quad (3)$$

$$10 > \log R > 4 \quad (4)$$

where a (mm) is the clearance between the tip 6 of the doctor 7 and the sleeve 2, b (mm) is the clearance between the sleeve 2 and the surface of the photosensitive layer 8, and R is the volume resistivity (ohms-cm) of the magnetic carrier in the two-component developer.

This embodiment of the invention is based on the new discovery that a toner image having a satisfactory density and quality can be formed by selecting the difference (b−a) of the two clearances above within a specified range depending upon the electric resistance of the carrier.

Figure 2:
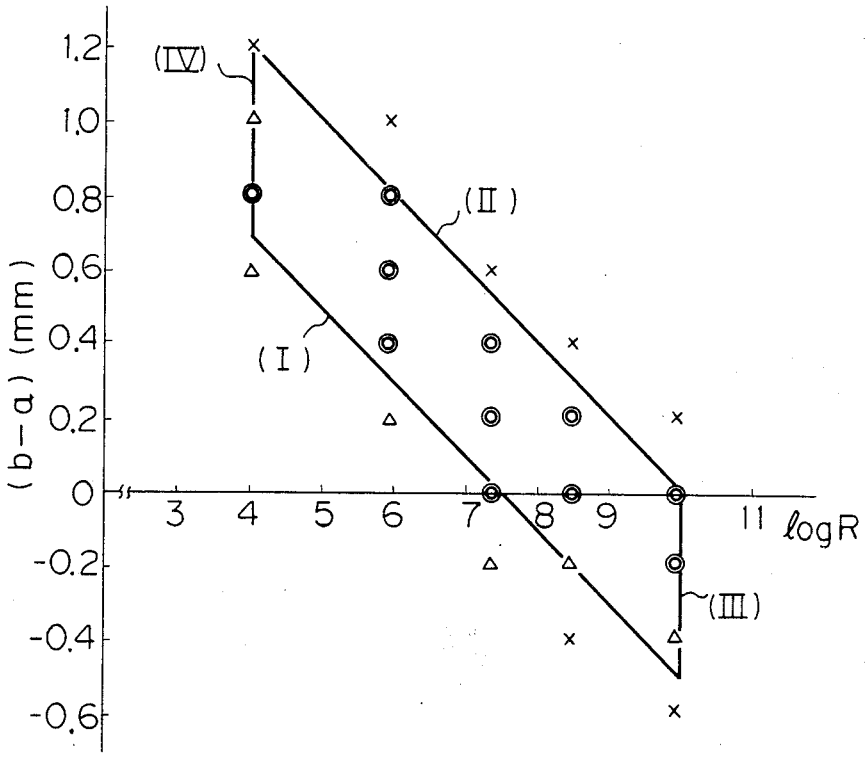
FIG. 2 is a graphic representation showing the relation between the electrical resistance of a carrier and (b-a)

FIG. 2 of the accompanying drawing is obtained by plotting the experimental results in an example to be described above. The electrical resistance R of the carrier is taken on the abscissa, and the difference (b−a) of the clearances, on the ordinate. In FIG. 2, the double circular marks refer to images having a density of at least 1.00 with no trouble in image quality. The X marks refer to images having an image density of less than 1.00. The triangular marks refer to images having quality defects such as trailing end missing, or having a reduced resolution.

The straight lines in FIG. 2 are defined by the following equations.

$$b-a = -0.2 \log R + 1.5 \quad (I)$$

$$b-a = -0.2 \log R + 2.0 \quad (II)$$

$$\log R = 10 \quad (III)$$

$$\log R = 4 \quad (IV)$$

It will be understood from FIG. 2 that to form an image having a high density and high quality, it is very critical to prescribe the developing conditions such that the (b−a) and logR values come within the region defined by the four straight lines (I), (II), (III) and (IV) above.

The difference (b−a) between the development clearance and the brush cutting clearance has closely to do with the development time which is the time during which the magnetic brush is in contact with the surface of the drum. If the difference (b−a) becomes larger, the development time becomes shorter. If the difference (b−a) becomes smaller, the development time becomes longer. If a carrier having a high electric resistance is used, the development time must be long in order to obtain the desired image density, namely the desired development current. On the other hand, with a carrier having a low electric resistance. a sufficient image density can be obtained by development for a short period of time. From the standpoint of preventing a decrease in the potential of the latent electrostatic image, the development time should preferably be shorter.

The development in this embodiment of the invention very well agrees with the experimental results plotted in FIG. 2. Specifically, in a region above the straight line II or on the right of straight line III, the image density is very low. In a region below the straight line I or on the left of straight line IV, the frictional contact is excessive, and consequently, the quality of the resulting image is considerably degraded. In contrast, according to this invention, an image having a high density and high quality can be obtained by performing the development under conditions defined by the area surrounded by these straight lines.

The clearance b between the drum and the sleeve and the brush cutting clearance a can be any values which conform to the aforesaid relation. The clearance b, however, is preferably 0.3 to 4 mm, especially 0.6 to 2 mm. If the b value exceeds the upper limit specified, the developer becomes difficult to hold on the surface of the sleeve and the toner and carrier particles tend to scatter. If it is below the specified limit, the amount of the developer on the sleeve surface is too small and the density of the developed image becomes low. The value a may be selected so as to satisfy the aforesaid relation on the basis of the aforesaid range of b.

According to the aforesaid embodiment of this invention, the development method has a very important advantage in practice in that the aforesaid advantage can be achieved without requiring a high level of mechanical precision in a developing section. If the (b−a) is set at nearly the middle of the aforesaid region, namely so as to substantially satisfy the following equation $$(b-a)=-0.2\log R+1.75,$$

according to the electrical resistance of a carrier used at the time of designing the developing device, errors of ±0.2 mm or more can be completely absorbed, and the work of accurate adjustment during assembling can be reduced. Furthermore, without so much increasing the accuracy of the development section, an image of high quality can be easily obtained.

A second additional condition pertains to the relation between the peripheral speed ($V_D$ mm/sec) of the surface of the drum and the peripheral speed ($V_S$ mm/sec) of the development sleeve. By further satisfying this condition, the toner scattering can be effectively prevented and a toner image having high quality and being free from fog or a decrease in density can be formed.

The second additional condition is that the development is carried out under conditions which satisfy the following expressions $$V_S/V_D \leqq -0.005V_D+5 \quad (1)$$

$$V_S/V_D \geqq -0.005V_D+3.5 \quad (2)$$

$$400 \geqq V_D \geqq 100 \quad (3)$$

where $V_D$ is the peripheral speed (mm/sec) of the surface of the drum, and $V_S$ is the peripheral speed (mm/sec) of the development sleeve.

This embodiment of the present invention is based on the finding that according to the developing conditions for the aforesaid method, there is an optimum range of the ratio of the peripheral speed of the development sleeve to the peripheral speed of the drum ($V_S/V_D$) depending upon the peripheral speed ($V_D$) of the photosensitive drum, and by performing the development under conditions within this range, a toner image of high density can be formed without troubles such as toner scattering, breaking, character blurring and fogging.

Figure 3:
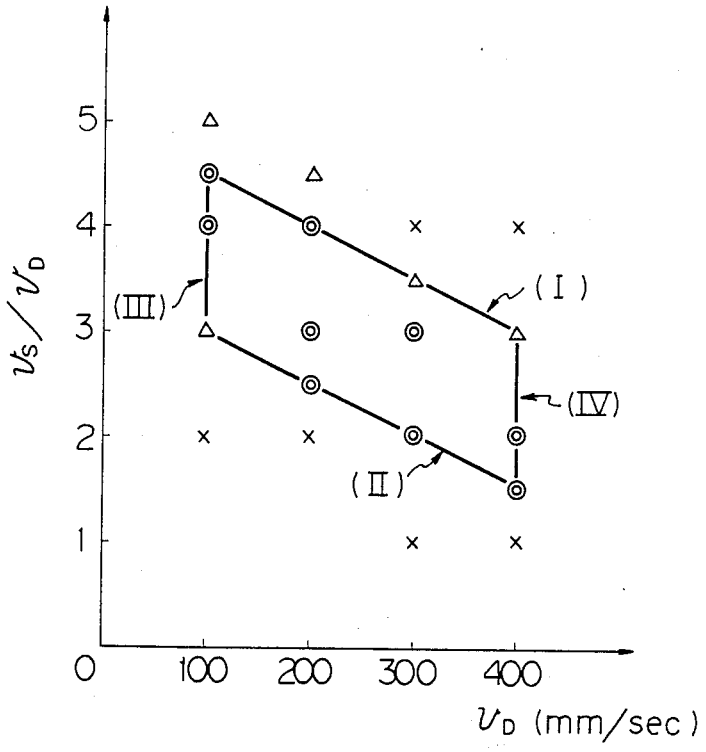
FIG. 3 is a graphic representation showing the relation between the peripheral speed ($V_D$) of a photosensitive drum and the ratio of the peripheral speed ($V_S$) of a development sleeve to that of the photosensitive drum.

FIG. 3 is a graphic representation showing the relation between the peripheral speed ($V_D$) of the drum taken on the abscissa and the ratio of the peripheral speed of the sleeve to the peripheral speed of the drum ($V_S/V_D$) taken on the ordinate, obtained by plotting the experimental results in an example given hereinafter. In FIG. 3, the double circular marks refer to images having an image density of at least 1.0 and being free from any trouble in image quality; the X marks refer to images having an image density of less than 1.0; and the triangular marks refer to images having quality defects such as trailing end missing, fogging and breaking or having a reduced resolution.

The straight lines in FIG. 3 are defined by the following.

$$V_S/V_D=-0.005V_D+5 \quad (I)$$

$$V_S/V_D=-0.005V_D+3.5 \quad (II)$$

$$V_D=100 \quad (III)$$

$$V_D=400 \quad (IV)$$

It will be understood from FIG. 3 that to form an image having a high density and high quality, it is very critical to prescribe the development conditions so that the values of $V_D$ and $V_S/V_D$ fall within the region defined by the four straight lines (I), (II), (III) and (IV).

The peripheral speed ($V_S$) of the development sleeve has to do with both the supply of the developer (toner) to the developing zone and the frictional contact of the magnetic brush with the surface of the photosensitive drum. Thus, when the peripheral speed ($V_D$) of the drum is varied, the peripheral speed ($V_S$) of the sleeve should also be varied accordingly. Namely, the $V_S/V_D$ ratio should be maintained constant. This is the covnentional concept. In contrast, it has been found unexpectedly in accordance with this invention that when the peripheral speed $V_D$ of the drum increases, the optimum $V_S/V_D$ value rather becomes lower. No sufficiently clear reason has yet been assigned to this quite unexpected fact. The present inventors, however, presume that under the developing conditions shown in FIG. 3, the $V_S/V_D$ ratio gradually decreases with increasing $V_D$, but $V_S$ itself tends to increase with increasing $V_D$, and that therefore, the increase of the centrifugal force on the magnetic brush contributes to the development of a latent electrostatic image.

In a region below straight line II in FIG. 3, the breaking of the image or its insufficient density is remarkable due to the insufficient supply of the toner, and there is a large tendency to fogging due to insufficient frictional contact. In a region above straight line I, trailing end missing occurs in the resulting image, or its resolution tends to decrease. Furthermore, the tendency to toner scattering increases. In contrast, according to this embodiment of the invention, an image having a high density and high quality and being free from fog attributed to toner scattering can be obtained by performing the development under conditions defined by the region surrounded by the straight lines in FIG. 3.

OTHER DEVELOPING CONDITIONS

In the developing method, the other developing conditions may be those known per se.

The carrier used may, for example, be a ferrite carrier or a known iron powder carrier. As the ferrite carrier, sintered ferrite particles, particularly spherical sintered ferrite particles, are used advantageously. The sintered ferrite particles preferably have a particle diameter of 20 to 200 microns in general.

If the particle diameter of the sintered ferrite particles is less than 20 microns, the flowability of the ferrite particles is reduced, and troubles tend to occur in the mixing and stirring of the carrier with the toner. On the other hand, if the particle diameter of the ferrite particles is larger than 200 microns, the amount of the toner that can be mixed becomes excessively small, and its control becomes difficult.

The sintered ferrite particles that can be used in this invention are known per se. For example, they are composed of one or more ferrites selected from zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFeO_3$), barium iron oxide ($BaFe_{12}O_{19}$), magnesium iron oxide ($MgFe_2O_4$). manganese iron oxide ($MnFe_2O_4$), and lanthanum iron oxide ($LaFeO_3$). Sintered ferrite particles composed of zinc manganese iron oxide are particularly suitable for the object of this invention.

Advantageously, the iron powder carrier has an electric resistance within the range described hereinabove and a particle diameter of 30 to 300 microns, and is particularly in the form of roundish particles with the corner portions removed.

The toner that can be used in this invention may be any colored toner having chargeability and fixability. It may be a granular composition having a particle diameter of 5 to 30 microns comprising a binder resin and dispersed therein, a coloring pigment, a charge controlling agent, etc. The resin may include thermoplastic resins, uncured thermosetting resins and initial condensates of thermosetting resins. Suitable examples of the resin include, in decreasing order of importance, vinyl aromatic resins such as polystyrene, acrylic resins, polyvinyl acetal resins, polyester resins, epoxy resins, phenolic resins, petroleum resins and olefinic resins. The pigment may be one or more of carbon black, Cadmium Yellow, Molybdenum Orange, Pyrazolone Red, Fast Violet B, Phthalocyanine Blue, etc. Examples of the charge controlling agent include oil-soluble dyes such as Nigrosine Base (CI50415), Oil Black (CI26150) and Spilon Black, metal naphthoates. fatty acid metal soaps, and resin acid soaps.

In the present invention, a bias voltage is applied between the photosensitive drum and the development sleeve. The bias voltage is prescribed such that the charge is sufficiently injected into the toner during development, but troubles such as discharge breakdown do not occur in the photosensitive drum or the magnetic brush. The suitable bias voltage is generally 100 to 500 volts, particularly 150 to 300 volts. The polarity of the bias voltage should be the same as that of the charge of the photosensitive drum.

Known electrophotographic materials may be used as the photosensitive plate. Examples are a selenium vapor-deposited photosensitive material, amorphous silicon photosensitive material, a CdS photosensitive material, and an organic photoconductive photosensitive material. A latent electrostatic image may be formed on the photosensitive material by methods known per se, for example by a combination of charging and imagewise exposure.

The following Examples illustrate the present invention more specifically.

EXAMPLE 1

A copying test was carried out under the following conditions in a copying machine having a developing device of the type shown in FIG. 1 built therein.

Photosensitive drum: Selenium
Surface potential: 750 V
Development bias: +200 V
Carrier: spherical ferrite carrier
  Electrical resistance (R) . . . $5.8\times10^7$ ohms-cm
  Particle diameter . . . 104 microns
  Saturation magnetization . . . 47 emu/g
  Specific surface area . . . 172 $cm^2/g$
Toner: toner having a specific surface area of 4139 $cm^2/g$
Magnet strength of the main pole: 800 gauss
Drum rotating speed ($V_D$): 200 mm/sec
Sleeve rotating speed ($V_S$): 600 mm/sec)
Drum-sleeve distance: 1.6 mm
Brush cutting clearance: 1.4 mm Uner these conditions, 10,000 copies were produced continuously at the varying toner concentrations indicated in Table 1. The toner concentration was detected by a commercial magnetic sensor (Model TS-003, a product of TDK), and the toner was supplied as required so as to maintain the toner concentration at a predetermined value.

TABLE 1

| Run | Toner concentration (Ct, %) | Initial density | Density of the 10000th copy | Image quality | Toner scattering |
|---|---|---|---|---|---|
| 1 | 2.39 (k = 0.6) | 1.08 | 1.05 | density low | no |
| 2 | 3.19 (k = 0.8) | 1.312 | 1.27 | good | no |
| 3 | 3.99 (k = 1.0) | 1.34 | 1.36 | good | no |
| 4 | 4.27 (k = 1.07) | 1.36 | 1.39 | generally good | slight |
| 5 | 4.79 (k = 1.2) | 1.42 | 1.35 | heavy fog | yes |

The results show that in the developing device shown in FIG. 1, the resulting copies can be used substantially for practical purposes at a k value in the range of 0.8 to 1.07.

EXAMPLE 2

Five carriers A to E shown in Table 2 were prepared for use in two-component developers.

TABLE 2

| Carrier | Volume resistivity R (ohms-cm)* | Particle diameter (microns) | Saturation magnetization (emu/g) |
|---|---|---|---|
| A | $1.1\times10^4$ | 91 | 61 |
| B | $8.1\times10^5$ | 84 | 53 |
| C | $2.0\times10^7$ | 86 | 69 |
| D | $8.5\times10^9$ | 94 | 67 |
| E | $4.3\times10^{10}$ | 97 | 55 |

*Developers were prepared by mixing the above carriers with a commercial toner (a product of Mita Industrial Co., Ltd.) for two-component developers so that the concentration of the toner became 4.5%.

A copying test was conducted in the developing device shown in FIG. 1 under the following conditions using the resulting developers at varying (b−a) values. The density, resolution, and other quality factors of the resulting image were measured, and the quality of the image was also evaluated from an overall consideration of the results obtained.

DEVELOPING CONDITIONS

Photosensitive drum: Selenium
Surface potential: 759 V
Development bias: +200 V
Carrier: the same conditions as in Example 1
Toner: Ct=3.99% (k=1.0); otherwise the same as in Example 1
$V_S$ and $V_D$: same as in Example 1
The results are shown in Tables 3 to 8.
The results are plotted in FIG. 2.

TABLE 3

| Used carrier: A | | | | | |
|---|---|---|---|---|---|
| Brush cutting clearance (a, mm) | D-S distance (b, mm) | (b − a) | Image density | Image quality | Overall evaluation |
| 1.6 | 3.0 | 1.4 | 0.88 | density insufficient and uneven | X |
| | 2.8 | 1.2 | 0.92 | density insufficient and uneven | X |
| | 2.6 | 1.0 | 1.26 | density uneven | Δ |
| | 2.4 | 0.8 | 1.45 | good | ◎ |
| | 2.2 | 0.6 | 1.41 | marked trailing end missing and poor tone reproduction | Δ |

(Note)
◎: excellent,
Δ: ordinary,
X: bad

TABLE 4

| Used carrier: B | | | | | |
|---|---|---|---|---|---|
| Brush cutting clearance (a, mm) | D-S distance (b, mm) | (b − a) | Image density | Image quality | Overall evaluation |
| 1.4 | 2.4 | 1.0 | 0.81 | density insufficient | X |
| | 2.2 | 0.8 | 1.12 | good | ◎ |
| | 2.0 | 0.6 | 1.34 | good | ◎ |
| | 1.8 | 0.4 | 1.41 | good | ◎ |
| | 1.6 | 0.2 | 1.46 | marked trailing end missing and poor tone reproduction | Δ |

(Note)
◎: excellent,
Δ: ordinary,
X: bad

TABLE 5

| Used carrier: C | | | | | |
|---|---|---|---|---|---|
| Brush cutting clearance (a, mm) | D-S distance (b, mm) | (b − a) | Image density | Image quality | Overall evaluation |
| 1.4 | 2.0 | 0.6 | 0.85 | density insufficient and uneven | X |
| | 1.8 | 0.4 | 1.18 | good | ◎ |
| | 1.6 | 0.2 | 1.32 | good | ◎ |
| | 1.4 | 0.0 | 1.42 | trailing end missing | Δ |
| | 1.2 | −0.2 | 1.41 | trailing end missing and poor tone reproduction | Δ |

(Note)
◎: excellent,
Δ: ordinary,
X: bad

TABLE 6

| Used carrier: D | | | | | |
|---|---|---|---|---|---|
| Brush cutting clearance (a, mm) | D-S distance (b, mm) | (b − a) | Image density | Image quality | Overall evaluation |
| 1.3 | 1.7 | 0.4 | 0.87 | density insufficient | X |
| | 1.5 | 0.2 | 1.21 | good | ◎ |
| | 1.3 | 0.0 | 1.35 | good | ◎ |
| | 1.1 | −0.2 | 1.39 | trailing end missing | Δ |
| | 0.9 | −0.4 | 1.34 | marked trailing missing | Δ |

(Note)
◎: excellent,
Δ: ordinary,
X: bad

TABLE 7

| Carrier used: E | | | | | |
|---|---|---|---|---|---|
| Brush cutting clearance (a, mm) | D-S distance (b, mm) | (b − a) | Image density | Image quality | Overall evaluation |
| 1.2 | 1.4 | 0.2 | 0.78 | density insufficient | X |
| | 1.2 | 0.0 | 1.06 | good | ◎ |
| | 1.0 | −0.2 | 1.23 | good | ◎ |
| | 0.8 | −0.4 | 1.20 | trailing end missing | Δ |
| | 0.6 | −0.6 | useless due to falling of the carrier | | X |

(Note)
◎: excellent,
Δ: ordinary,
X: bad

TABLE 8

| Carrier used: F | | | | | |
|---|---|---|---|---|---|
| Brush cutting clearance (a, mm) | D-S distance (b, mm) | (b − a) | Image density | Image quality | Overall evaluation |
| 1.2 | 1.2 | 0.0 | 0.65 | density insufficient | X |
| | 1.0 | −0.2 | 0.71 | density insufficient | X |

TABLE 8-continued

| Brush cutting clearance (a, mm) | D-S distance (b, mm) | Carrier used: F (b − a) | Image density | Image quality | Overall evaluation |
|---|---|---|---|---|---|
| | 0.8 | −0.4 | 0.83 | cient density insuffi-cient | X |
| | 0.6 | −0.6 | useless due to falling of the carrier | | X |
| | 0.4 | −0.8 | useless due to falling of the carrier | | X |

(Note)
X: bad

EXAMPLE 3

A copying machine having the developing device shown in FIG. 1 built in it was used, and a copying test was conducted under the following conditions.

Photosensitive drum: Selenium
Surface potential: 750 V
Development bias: +200 V
Carrier: spherical ferrite carrier
Electrical resistance . . . $5.8\times10^7$ ohms
Particle diameter . . . 104 microns
Saturation magnetization . . . 47 emu/g
Specific surface area . . . 172 $cm^2/g$
Toner: specific surface area 4139 $cm^2/g$
Toner concentration (Ct, %): 3.99% (k=1.0)
Magnet strength of the main pole: 800 gauss The copying test was conducted under the above conditions while varying the peripheral speed ($V_D$, mm/sec of the drum surface and the peripheral speed ($V_S$), mm/sec) of the development sleeve as indicated in Table 9. The results are shown in Table 9.

TABLE 9

| $V_D$ (mm/sec) | $V_S/V_D$ | Image density | Image Quality | Toner Scat-tering | Others | Overall evaluation |
|---|---|---|---|---|---|---|
| 100 | 2 | 0.76 | density insufficient and uneven | ○ | | X |
| | 3 | 1.02 | " | ○ | | Δ |
| | 4 | 1.21 | good | ○ | | ◎ |
| | 4.5 | 1.28 | good | ○ | | ◎ |
| | 5 | 1.33 | marked trailing end missing | ○ | | Δ |
| 200 | 2 | 0.82 | density insufficient and uneven | ○ | | X |
| | 2.5 | 1.16 | good | ○ | | ◎ |
| | 3 | 1.34 | good | ○ | | ◎ |
| | 4 | 1.37 | good | Δ | | ◎ |
| | 4.5 | 1.36 | marked trailing end missing | × | large driving torque | Δ |
| 300 | 1 | 0.68 | density insufficient and uneven, and heavy fogging | ○ | | X |
| | 2 | 1.28 | good | ○ | | ◎ |
| | 3 | 1.33 | good | Δ | | ◎ |
| | 3.5 | 1.35 | trailing end missing | X | large driving torque | Δ |
| | 4 | 1.35 | marked trailing end missing | X | large driving torque | X |
| 400 | 1 | 0.73 | density insufficient and uneven, and heavy fogging | ○ | | X |
| | 1.5 | 1.22 | good | ○ | | ◎ |
| | 2 | 1.27 | good | Δ | | ◎ |
| | 3 | 1.31 | marked trailing end missing | X | large driving torque | Δ |
| | 4 | 1.30 | marked trailing end missing | X | large driving torque | X |

(Note)
◎: excellent,
○: good,
Δ: ordinary,
X: bad

What is claimed is:

1. A development method for forming a toner image of high quality, which comprises supplying a two-component developer composed of a mixture of magnetic carrier particles and toner particles chargeable by frictional contact with the magnetic carrier particles onto a development sleeve comprising a non-magnetic sleeve and provided therein, a magnet having alternately and circumferentially arranged magnetic poles of different polarities to thereby form a magnetic brush of the developer, and bringing the surface of a photosensitive drum bearing a latent electrostatic image into frictional contact with the magnetic brush while a bias voltage is applied between the photosensitive drum and the sleeve thereby to form a toner image corresponding to the latent electrostatic image; characterized in that a brush cutting doctor is disposed on the non-magnetic sleeve so that the tip of the doctor is positioned nearly centrally between two magnetic poles of different polarities, and the development is carried out while moving the photosensitive drum and the development sleeve in the same direction at the site of frictional contact under conditions which satisfy the following expressions $$(b-a) > -0.2 \log R + 1.5$$

$$(b-a) < -0.2 \log R + 2.0$$

$$10 > \log R > 4$$

wherein a is the clearance (mm) between the tip of the doctor and the development sleeve, b is the clearance (mm) between the development sleeve and the surface of the photosensitive drum, and R is the volume resistivity (ohms-cm) of the magnetic carrier, and the concentration (Ct, %) of the toner in the developer satisfies the following equation $$Ct = k \cdot \frac{Sc}{St + Sc} \times 100$$

wherein Sc is the specific surface area ($cm^2/g$) of the carrier, St is the specific surface area ($cm^2/g$) of the toner, and k is a number of from 0.80 to 1.14.

2. The method of claim 1 wherein the magnetic carrier is a carrier composed of sintered ferrite particles having a particle diameter of 20 to 200 microns.

3. The method of claim 1 wherein the magnetic carrier is an iron powder carrier having a particle diameter of 30 to 300 microns.

4. The method of claim 1 wherein the toner particles are a granular composition having a particle diameter of 5 to 30 microns comprising a binder resin and dispersed therein at least a colored pigment and a charge controlling agent.

5. The development method of claim 1 wherein the clearance b between the development sleeve and the surface of the photosensitive drum is 0.3 to 4 mm and the clearance a between the tip of the doctor and the development sleeve is selected so as to satisfy the relation on the basis of the range of b.

6. The development method of claim 1 wherein development is carried out under conditions which satisfy the equation $$(b-a) = -0.2 \log R + 1.75.$$

7. A development method for forming a toner image of high quality, which comprises supplying a two-component developer composed of a mixture of magnetic carrier particles and toner particles chargeable by frictional contact with the magnetic carrier particles onto a development sleeve comprising a non-magnetic sleeve and provided therein, a magnet having alternatively circumferentially arranged magnetic poles of different polarities to thereby form a magnetic brush of the developer, and bringing the surface of a photosensitive drum bearing a latent electrostatic image into frictional contact with the magnetic brush while a bias voltage is applied between the photosensitive drum and the sleeve thereby to form a toner image corresponding to the latent electrostatic image; characterized in that a brush cutting doctor is disposed on the non-magnetic sleeve so that the tip of the doctor is positioned nearly centrally between the two magnetic poles of different polarities and the development is carried out while moving the photosensitive drum and the development sleeve in the same direction at the site of frictional contact under conditions which satisfy the following expressions $$(b-a) > -0.2 \log R + 1.5$$

$$(b-a) < -0.2 \log R + 2.0$$

$$10 > \log R > 4$$

wherein a is the clearance (mm) between the tip of the doctor and the development sleeve, b is the clearance (mm) between the development sleeve and the surface of the photosensitive drum, and R is the volume resistivity (ohms-cm) of the magnetic carrier, $$V_S/V_D \leqq -0.005\, V_D + 5$$

$$V_S/V_D \geqq -0.005\, V_D + 3.5$$

$$400 \geqq V_D \geqq 100$$

wherein $V_D$ is the peripheral speed (mm/sec) of the surface of the photosensitive drum, and $V_S$ is the peripheral speed (mm/sec) of the development sleeve, and the concentration (Ct, %) of the toner in the development satisfies the following equation $$Ct = k \cdot \frac{Sc}{St + Sc} \times 100$$

wherein Sc is the specific surface area ($cm^2g$) of the carrier, St is the specific surface area ($cm^2g$) of the toner, and k is a number of from 0.80 to 1.14.

8. A development method for forming a toner image of high quality, which comprises supplying a two-component developer composed of a mixture of magnetic carrier particles and toner particles chargeable by frictional contact with the magnetic carrier particles onto a development sleeve comprising a non-magnetic sleeve and provided therein, a magnet having alternately circumferentially arranged magnetic poles of different polarities to thereby form a magnetic brush of the developer, and bringing the surface of a photosensitive drum bearing a latent electrostatic image into frictional contact with the magnetic brush while a bias voltage is applied between the photosensitive drum and the sleeve thereby to form a toner image corresponding to the latent electrostatic image; characterized in that a brush cutting doctor is disposed on the non-magnetic sleeve so that the tip of the doctor is positioned nearly centrally between two magnetic poles of different polarities and the development is carried out while moving the photosensitive drum and the development sleeve in the same direction at the site of frictional contact under conditions which satisfy the following expressions $$V_S/V_D \leqq -0.005\, V_D + 5$$

$$V_S/V_D \geqq -0.005\, V_D + 3.5$$

$$400 \geqq V_D \geqq 100$$

wherein $V_D$ is the peripheral speed (mm/sec) of the surface of the development sleeve, and the concentration (Ct, %) of the toner in the developer satisfies the following equation $$Ct = k \cdot \frac{Sc}{St + Sc} \times 100$$

wherein Sc is the specific surface area ($cm^2g$) of the carrier, St is the specific surface area ($cm^2g$) of the toner and k is a number of from 0.80 to 1.14.

9. The method of claim 8 wherein the magnetic carrier is a carrier composed of sintered ferrite particles having a particle diameter of 20 to 200 microns.

10. The method of claim 8 wherein the magnetic carrier is an iron powder carrier having a particle diameter of 30 to 300 microns.

11. The method of claim 8 wherein the toner particles are a granular composition having a particle diameter of 5 to 30 microns comprising a binder resin and dispersed therein at least a colored pigment and a charge controlling agent.

* * * * *

UNITED STATES PATENT AND TRADEMARK OFFICE

CERTIFICATE OF CORRECTION

PATENT NO. : 4,672,017

DATED : June 9, 1987

INVENTOR(S) : YASUSHI KAMEZAKI

It is certified that error appears in the above-identified patent and that said Letters Patent is hereby corrected as shown below:

IN THE CLAIMS

Column 16, line 25, claim 8, after "alternatively", insert --and--; line 48, after "the", insert --photosensitive drum, and $V_S$ is the peripheral speed (mm/sec) of the--.

Signed and Sealed this

Third Day of November, 1987

*Attest:*

DONALD J. QUIGG

*Attesting Officer*

*Commissioner of Patents and Trademarks*